US005388381A

United States Patent [19]

Bilinski et al.

[11] Patent Number: 5,388,381

[45] Date of Patent: Feb. 14, 1995

[54] INTERLOCKING BUILDING PANEL

[75] Inventors: Walter J. Bilinski, Alpharetta, Ga.; John M. Getz, San Francisco, Calif.; James R. Kline, Petoskey, Mich.; Douglas F. Hudson, Jr., Miami, Fla.

[73] Assignee: General Electric Company, Pittsfield, Mass.

[21] Appl. No.: 6,877

[22] Filed: Jan. 21, 1993

[51] Int. Cl.[6] ..... E04D 1/34

[52] U.S. Cl. ..... 52/519; 52/547; 52/551

[58] Field of Search ..... 52/519, 531, 547, 551

[56] References Cited

U.S. PATENT DOCUMENTS

| | | | |
|---|---|---|---|
| 2,766,861 | 10/1956 | Abramson | 52/545 |
| 3,120,082 | 2/1964 | Mendelsohn | 52/531 |
| 3,217,453 | 11/1965 | Medow | 52/539 |
| 3,220,150 | 11/1965 | Besse | 52/538 |
| 3,229,436 | 6/1966 | Gerhart et al. | 52/531 |
| 3,233,382 | 2/1966 | Graveley | 52/522 |
| 3,363,380 | 1/1968 | Merrill | 52/521 |
| 3,473,274 | 10/1969 | Godes | 52/531 |
| 3,605,369 | 9/1971 | Merrill et al. | 52/530 |
| 3,613,326 | 10/1971 | Mollman | 52/314 |
| 3,667,184 | 6/1972 | Merrill | 52/530 |
| 3,686,813 | 8/1972 | Breitwieser et al. | 52/521 |
| 3,897,667 | 8/1975 | Turek | 52/555 |
| 3,899,855 | 8/1975 | Gadsby | 52/520 |
| 4,015,391 | 4/1977 | Epstein et al. | 52/520 |
| 4,251,967 | 2/1981 | Hoofe, III | 52/555 |
| 4,343,126 | 8/1982 | Hoofe, III | 52/521 |
| 4,598,522 | 7/1986 | Hoofe, III | 52/555 |
| 4,731,970 | 3/1988 | Marshall et al. | 52/543 |
| 5,074,093 | 12/1991 | Meadows | 52/537 |

*Primary Examiner*—James L. Ridgill, Jr.

[57] ABSTRACT

The present invention provides an interlock assembly for joining adjacent building panels, said assembly comprising:

(a) a pair of interlock assembly elements, each assembly element having integral therewith:

(i) first complementary means for matingly engaging the assembly elements in an engaged position; and (ii) second complementary means for forcing and maintaining the first complementary means in the engaged position, wherein said second complementary means are separate and disposed away from said first complementary means.

3 Claims, 2 Drawing Sheets

INTERLOCKING BUILDING PANEL

FIELD OF THE INVENTION

This invention relates to building siding and roofing materials of the type used in surfacing exterior walls and roofs of buildings, and more particularly to improved plastic siding and roofing panels having integrally formed interlocking assembly elements along the panel edges which are provided to facilitate mounting the siding or roofing panels on a building structure, and having support rib elements disposed in the panels which are utilized to provide the panels with improved structural weight-bearing capabilities.

DESCRIPTION OF THE PRIOR ART

It is well-known to use building siding and roofing panels formed of metal, e.g. aluminum, or of synthetic resinous materials, e.g. plastic and foams, shaped for and adapted to be mounted on a wall or roof in order to simulate a multiplicity of, e.g., cedar shakes, stones, bricks or weatherboarding. Such siding and roofing panels are conventionally formed with (1) a plurality of elongated nailing slots adjacent their top edge for securing the individual panels to, e.g., the building wall studs or roof rafters or sheathing, and (2) an interlocking assembly comprised of a downwardly directed open channel or clip (adjacent the nailing slots) which is adapted to engage and cooperate with an upwardly directed lip formed on the bottom edge of a second panel mounted thereabove so as to retain the bottom edge of the second panel in position. This interlocking assembly, in cooperation with the elongated nailing slots, is said to permit substantial expansion movement of the respective siding and roofing panels and is also said to permit air passage, or breathing, through the interlocking joints.

In forming such prior art siding and roofing panels from plastic materials such as polyvinyl chloride or the like by extrusion processes or being molded, such as by injection molding, substantial difficulty has been encountered in maintaining the dimensions of the various components within the necessary degree of tolerance so as to enable easy assembly of the panels one with the other while, at the same time, assuring the desired fit of the interlocking assembly between the flange and the channel and lip. Numerous factors such as variations in temperature of the thermoplastic material being extruded or molded, the age and quality of the plastic materials and variation in the cooling rates of such materials, particularly where complex cross-sectional shapes are involved, can affect such tolerances. Differential cooling can also result in warping of the plastic material and such warping, particularly in the area of the channel and lip, can result in either an excessively loose or tight joint. An excessively tight joint can result in buckling of the panels or, in the extreme, disengagement of one panel from another. An excessively loose joint can result in rattling during even mild wind conditions.

There are times, moreover, when severe wind and rain occur together which can cause the rain to accelerate and thereby penetrate further than normal. Under these adverse conditions, the wind easily causes uplifting of the bottom horizontal edge of the panels and allows the penetrating rain to enter underneath the panel edge and become trapped in the space between it and the wall or roof. Once water enters this stagnant air space, it is very difficult to drive the moisture therefrom.

In addition, the prior art siding and roofing panels which utilize the aforementioned downwardly directed open channel and upwardly directed lip suffer from the lack of a positive force which maintains the panel in the engaged interlocked position. This thus necessitates that at least two persons be present to effect the installation of the panels, one to hold the panels in the engaged interlocked position and one to nail the panel in place. Effectively, there is no upwardly directed force preventing the engaged interlocked panel from sliding at least partially (and sometimes completely) down the wall or roof and out of nailing position before it is nailed in place.

Various attempts have been made to provide an interlocking assembly which will permit relative movement due to expansion and which will, at the same time, provide more positive interlocking engagement of the siding or roofing panels. For example, cooperating hook-shaped or ratchet-tooth elements have been integrally molded on the flange forming the channel and the cooperating lip. This arrangement has not been entirely satisfactory, however, since a substantial locking force is required to engage the ratchet teeth and a failure to properly engage the ratchet teeth can result. Further, it frequently occurs that once installed a panel has to be removed (for example for recutting) before being finally nailed into position, and such interlocking ratchet teeth not only present difficulty in removing the panel, but also can be damaged during such removal rendering the interlock ineffective for its intended purpose.

More specifically, numerous designs for interlocking, roofing and siding panels have been patented, and one such design can be referred to as a "horizontal interface, top-bottom catch" type design. In this design type, the upper horizontal edge of the panels are secured to the rafters of a roof or to a vertical wall stud. A mating mechanism exists in the combination of the upper edge of one panel and the lower edge of another panel (on the next higher "course" or "tier"), and this mating mechanism interlocks the panels.

Among the patents which generally relate to this type of interlocking mechanism are Medow, U.S. Pat. No. 3,217,453; Mollman, U.S. Pat. No. 3,613,326; Gadsby, U.S. Pat. No. 3,899,855; Breitwieser, U.S. Pat. No. 3,686,813; Epstein et al., U.S. Pat. No. 4,015,391; and Hoofe, III, U.S. Pat. Nos. 4,251,967 and 4,598,522.

Also showing more specific horizontal interface, top-bottom catch designs for interlocking roofing and siding panels are the following patents.

In Graveley, Jr., U.S. Pat. No. 3,233,382, there is shown a siding panel having a top marginal edge which is provided with a continuous rib on the projecting edge of a V-shaped pocket. The rib is said to have the dual effects of strengthening the panel against flexing while simultaneously providing an automatic point of interlock with an appropriately formed lower marginal edge. With regard to this lower marginal edge, the patent describes providing the same with a locking flange which snaps under the above-described upper rib and which, upon insertion, automatically locks the locking flange into the V-shaped pocket of the above adjacent panel.

In Merrill, U.S. Pat. No. 3,363,380; and Merrill et al., U.S. Pat. Nos. 3,605,369 and 3,667,184, there are disclosed a shingle construction in which the lower end of the shingle has integral therewith a section which extends inward of the shingle to form a holding strip for lower adjacent shingles and the upper edge of the body section of this shingle has a metal connecting strip integral therewith for interlocking with the holding strip of an upper adjacent shingle. The upper metal connecting strip includes a portion which extends toward the lower end edge of the main body section of the shingle in spaced parallel relation with the upper surface of the main body section of the shingle so as to define a slot between the portion which extends towards the lower end edge and the body section. This slot is adapted to receive a holding strip of an adjacent upper shingle. In practice, the extending section from the lower edge of an upper shingle is inserted into the defined slot along the upper edge of the lower shingle.

The above four patented designs are, however, subject to certain drawbacks. Specifically, the upper course of shingles must be held in place manually while it is nailed to the rafter or stud.

In U.S. Pat. No. 4,343,126, an arrangement is shown for securing an upper course of shingles to a lower course of shingles, the arrangement including providing a "S" bend to the upper edge of the lower course of shingles, providing an upwardly directed channel which is adapted to receive the lower flange edge of the panel in the next higher course of shingles in an assembly. In practice, the lower flange of the higher course of panels is dropped into the upper directed horizontal channel.

This design also has its drawbacks including, inter alia, that water can become trapped in the upwardly directed opening of the "S" bend.

Also according to the prior art building panels, those panels are generally provided with an unexposed surface substantially planar in nature which is rested against the wall studs or roofing rafters or sheathing when the panel is in the installed position. These panels also have a generally raised decorative exposed surface which is intended to depict cedar shakers, stones or bricks, as the case may be. Such panels also suffer from the drawback in that they are of a completely "filled" structure, e.g. a foamed material or composite, which serves to increase the cost of raw materials for the panels due to the necessity of filling the unexposed portion of the panel.

This has drawbacks in that it serves to increase the cost of production and increase the weight of the individual panels. It would be advantageous to eliminate the use of excessive raw materials in the production of building panels, both from a cost of material and weight standpoint.

SUMMARY OF THE INVENTION

Accordingly, an object of the present invention is to provide a wall or roofing panel, preferably a decorative panel, which prevents water from entering underneath the horizontal lower edge and forming a high humidity condition within the stagnant air space between the wall panel and the wall.

Another object of the present invention is to provide a wall or roofing panel which prevents wind from lifting adjacent panels.

Another object of the present invention includes providing a wall or roof covering which allows for easy and foolproof installation whereby horizontal and vertical alignment between panels is easily attained and maintained.

Another object of the present invention is to provide a wall or roofing panel which allows for both horizontal and vertical contraction and expansion while maintaining the aforesaid moisture barrier between adjacent panels.

Another object of the present invention is to provide a wall or roofing panel which exhibits a secure fit so that the panels will remain locked in place prior to nailing in position and, moreover, which provides an audible indication, such as by a "click", alerting the installer that the panel is properly in place.

Accordingly, the present invention provides, in one embodiment, an interlock assembly for joining adjacent building panels, said assembly comprising:

(a) a pair of interlock assembly elements, each assembly element having integral therewith:
  (i) first complementary means for matingly engaging the assembly elements in an engaged position; and
  (ii) second complementary means for forcing and maintaining the first complementary means in the engaged position, wherein said second complementary means are separate and disposed away from said first complementary means.

In addition, the present invention provides, in an alternative embodiment, a decorative building panel comprising:

(a) at least one course comprised of a plurality of decorative building elements;
(b) a continuous interlock assembly element disposed along one edge of said course;
(c) at least one non-continuous interlock assembly element disposed along an opposite edge of said course; and
(d) a support rib disposed within each decorative building element, wherein said continuous interlock assembly element comprises
  (i) first complementary means for matingly engaging the non-continuous interlock assembly element of an adjacent building panel and
  (ii) second complementary means for forcing and maintaining the continuous and non-continuous interlock assembly elements in an engaged position, and wherein said support rib is disposed in each of said decorative building elements to provide resistance to the deformation of said decorative building element.

DESCRIPTION OF THE PREFERRED EMBODIMENTS

Figure 1:
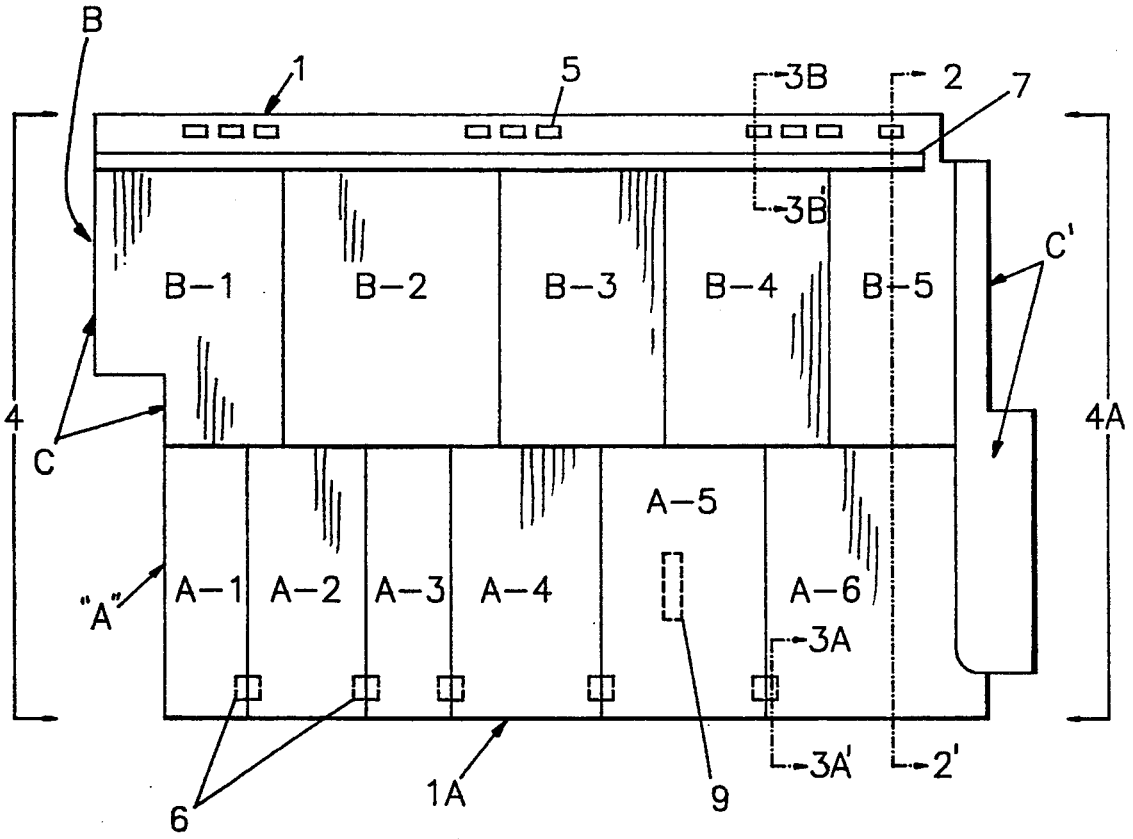
FIG. 1 is a top plan view of a building panel according to the present invention.

Detailed embodiments of the present invention are disclosed hereinafter with respect to the drawings. However, it is understood that the disclosed detailed embodiments are merely exemplary of the invention which, of course, may be embodied in various forms. Therefore, any specific structure or function of the details disclosed hereinafter are not to be interpreted as limiting the present invention, but merely as a representation for teaching one skilled in the art to employ the present invention in virtually any appropriately detailed structure.

Reference is now made to the drawings wherein like characters among the various FIGURES are denoted by the same reference numeral.

FIG. 1 illustrates, in top plan view, a preferred embodiment of applicants' decorative building panel. Generally at "A", a first "course" or "tier" of decorative building elements ("A-1" through "A-6" running from left to right) and, thereabove at "B", a second course of decorative building elements ("B-1" through "B-5" also running left to right) are shown. The decorative building panel as illustrated in FIG. 1 comprises two long sides, 1 and 1A, respectively, and two short sides, 4 and 4A, respectively. For purposes of the present description, and where the decorative building panel is a siding panel or roofing panel, long side 1 will generally be installed as the "top" and long side 1A will generally be installed as the "bottom", with two decorative building panels being installed in a vertical-type relationship. Short sides 4 and 4A reflect overlap areas, generally referred to in FIG. 1 as "C" and "C'". These overlap areas, for effecting installation of the decorative building panels in lateral relationship, can be of any generally accepted configuration, including those such as shown in Merrill et al., U.S. Pat. No. 3,605,369; Mollman, U.S. Pat. No. 3,613,326; Merrill et al., U.S. Pat. No. 3,667,184; Turek, U.S. Pat. No. 3,897,667; and the like. In practice, the decorative building panels of the present invention, and as shown generally in FIG. 1, are installed in adjacent rows (with area "C" of one panel overlapping with area "C'" of an adjacent panel) along, e.g., a wall or roof of a building structure.

Installation begins at the lower left position of the wall or roof, proceeds in rows from left to right, and thereafter repeats in continuous rows, a subsequent row being vertically disposed adjacent to the previous row. The first row of decorative building panels, not having an adjacent building panel below it, is installed by, e.g., first applying a strip of continuous interlock assembly element, such as shown in cross-section in FIG. 3B, and indicated at 7 on the panel shown in FIG. 1, at an appropriate location along the bottom edge of the building structure to be covered with the decorative building panels according to the present invention.

Thereafter, a first row of decorative building panels according to FIG. 1 can be installed in overlapping configuration from left to right along the continuous interlock assembly element by matingly engaging the non-continuous interlock assembly elements 6 of the first row of building panels therewith. As each building panel is matingly engaged with the continuous interlock assembly element, it is forcibly placed into and supportably maintained in the engaged position by the novel second complementary means according to the present invention which is described in detail hereinbelow. Once a decorative building panel is in an engaged position, it is maintained according to the present invention in its mating engagement, thus freeing the installer's hands for the nailing operation effected by driving nails through appropriately spaced holes 5. Each decorative building panel has as an integral part a continuous interlock assembly element 7, thus providing an area of contact for the non-continuous interlock assembly elements 6 of the next vertically disposed decorative building panel.

Figure 2:
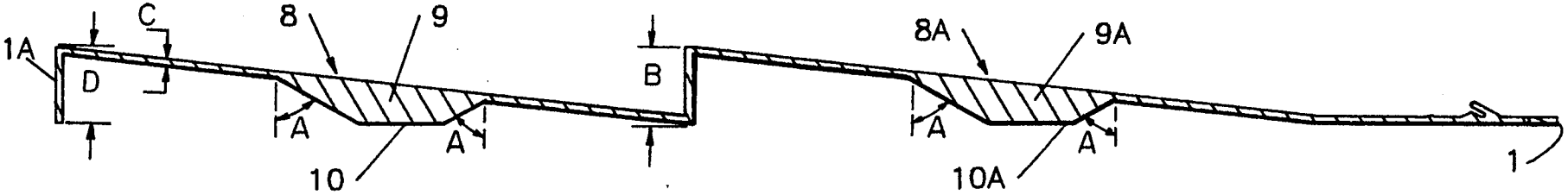
FIG. 2 is a cross-sectional view taken along line "2—2'" of FIG. 1.

FIG. 2 illustrates a schematic cross-sectional view through line 2—2' of FIG. 1. As can be seen in FIG. 2, a preferred embodiment of the decorative building panel of the present invention comprises a panel which includes two courses 8 and 8A of decorative elements and, when viewed in conjunction with FIG. 1, the decorative element indicated generally at 8 in FIG. 2 corresponds to the first course, generally referred to as "A" in FIG. 1, and the decorative element indicated generally at 8A in FIG. 2 corresponds generally to the second course, generally referred to as "B" in FIG. 1.

Also shown in FIG. 2 are the novel support ribs 9 and 9A which constitute an additional embodiment of the present invention. Heretofore, the decorative elements, e.g., shakes, shingles, etc., which comprised the decorative elements of the prior art building panels were substantially solid in nature, thus adding to the weight and cost of fabrication of the building panels. In this regard, mention can be made of Merrill et al., U.S. Pat. No. 3,605,369 and Marshall et al., U.S. Pat. No. 4,731,970. According to one embodiment of the present invention, each decorative panel element A-1 through A-6 and B-1 through B-5 (see, particularly element A-5 of FIG. 1) has disposed therein a support rib 9 of sufficient size and strength so as to provide resistance to flexing of the decorative panel in the direction of the support rib. As can be seen from FIGS. 1 and 2, the support ribs 9 and 9A are generally disposed toward the center of the decorative element and are structured so as to provide a flat surface 10 and 10A which substantially continuously contacts the underlying building structure, e.g., the sheathing material of the roof and/or the studs of the wall of the building structure.

The support ribs 9 and 9A perform two functions. First, the support ribs serve to effectively subdivide the surface of the decorative elements of the panels into smaller areas, thus reducing the likelihood that the decorative element will sag over time and, second, the support ribs provide resistance to flexural deformation of the decorative element thereby improving the weight-bearing capacity of the decorative elements.

Because each decorative element contains such a support rib (not shown as such in FIG. 1), the building panels according to the present invention provide substantially improved weight-support characteristics, especially when used as a roofing panel. Accordingly, the building panels according to the present invention which utilize the disclosed support ribs, can provide a surface upon which the installer can walk without fear of substantially deforming and/or breaking the individual decorative building elements. The support ribs can be of any effective shape, a generally rhombi shape 9 and 9A being depicted in FIG. 2 as the preferred embodiment from a manufacturing viewpoint.

In FIG. 2, the distance from 1 to 1A can be any convenient length of from about 10 to about 36 inches and preferably is from about 20 to about 24 inches. Angle "A" can be any angle from 0° to 90°, preferably is from 45° to 60°, and more preferably is about 60° C. Side "B" can be any length of from about ¼ inch to about 2 inches, preferably is from about ½ to about 1½ inches, and more preferably is about 1 inch. Thickness "C" of the panel body can range from 0.01 inch to about 0.25 inches, is preferably from about 0.05 to about 0.15 inches, and more preferably is about 0.1 inch. The depth of side 1A, as indicated as "B" in FIG. 2 is generally not as great as the depth of "B", thereby providing room to accommodate overlap with the thickness of an adjacent building tile. Thus, where, for example, the depth of "B" is 1 inch, and the thickness "C" of the building panel is about 0.1 inch, the depth of side 1A, as indicated at "D" will be approximately 0.9 inches.

Figure 3A:
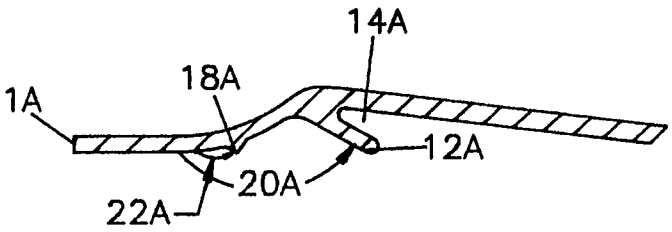
FIG. 3A is an enlarged cross-sectional view through line "3A—3A'" of FIG. 1.
Figure 3B:
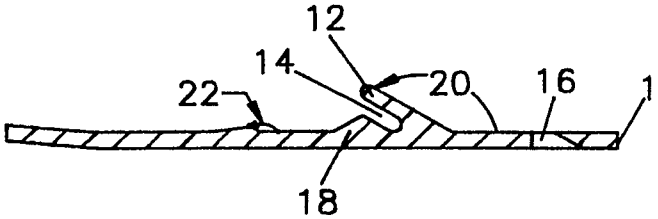
FIG. 3B is an enlarged cross sectional view through line "3B—3B'" of FIG. 1.
Figure 3:
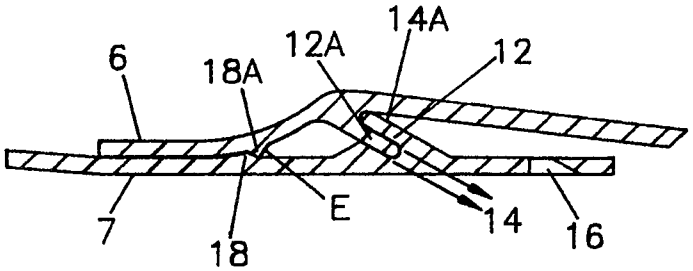
FIG. 3 is a cross-sectional view through an enlargement of the interlock assembly of the present invention in the engaged position.

In FIG. 3, there is illustrated first complementary means in mating engagement comprised of a non-continuous interlock assembly element 6 (as shown alone in FIG. 3A and referred to as element 6 in FIG. 1) and a continuous interlocking assembly element 7 (as shown alone in FIG. 3B and referred to as element 7 in FIG. 1). In FIG. 3, as part of the continuous interlocking assembly element 7, there is shown a lip 12, a groove 14 for receiving the reciprocal lip 12A of the non-continuous interlocking assembly element 6, a nail hole 16, and one portion 18 of the second complementary means for forcing and maintaining the first complementary means in the engaged position.

Also as shown in FIG. 3, the non-continuous interlocking assembly element 6 is likewise comprised of a lip 12A, which is configured and adapted so as to, preferably, substantially conform to the configuration of the groove 14 in the continuous interlocking assembly element 7. Also, the non-continuous interlocking assembly element 6 preferably comprises a reciprocal groove 14A adapted to receive the lip 12 of the continuous interlocking assembly element. Still further, the non-continuous interlocking assembly element contains the other portion 18A of the second complementary means for forcing and maintaining the first complementary means in the engaged position. This is shown generally at "E" in FIG. 3, and one side of protrusion 18 in FIG. 3 is designed so as to substantially completely interface with one side of protrusion 18A of the non-continuous interlocking assembly element of FIG. 3.

Explaining the function of the second complementary means in greater detail, as the interlocking assembly element lip 12A of the non-continuous assembly element 6 of FIG. 3 begins engagement with the groove 14 of the continuous interlocking element 7 of FIG. 3, portion 18A of the second complementary means for forcing and maintaining the first complementary means in the engaged position comes into close proximity with portion 18 of the second complementary means for forcing and maintaining the first complementary means in the engaged position. As the engagement of lip 12A in groove 14 becomes substantially complete, the two portions 18A and 18 of the second complementary means interface and ultimately, snap into place, with the complementary side-by-side engagement of 18A with 18 causing a forced movement of the lip 12A of the non-continuous interlock assembly element 6 of FIG. 3 into the groove 14, thus forcing the first complementary means into the engaged position. In addition, the complementary side-by-side engagement of elements 18A and 18, as depicted in FIG. 3, serves to maintain the first complementary means in the engaged position, so as to prevent the non-continuous interlock assembly element 6 from disengaging from the continuous interlocking assembly element 7.

In contradistinction to those partial interlocks of the prior art, the interlock of the present invention serves to provide a force in the direction of the apex of the groove 14 depicted in FIG. 3 and, in normal use on walls or roofs, serves to provide an "upward" interlock. The prior art interlocks all depend upon closure effected by the "downward" force of one interlock assembly element upon the other, not by the positive upward force provided in accordance with the present invention.

Details of the interlock assembly according to the present invention can be seen in FIGS. 3A and 3B. In both FIGS. 3A and 3B, the respective lips 12A and 12 of the non-continuous interlock assembly element 6 (FIG. 3A) and the continuous interlock assembly element 7 (FIG. 3B) are disposed at an angle of greater than 90° C., measured in the counterclockwise direction, as depicted by arrows 20A and 20 in FIGS. 3A and 3B, from the long sides, 1 and 1A, respectively. Preferably, the angle depicted by the arrows 20A and 20 in FIGS. 3A and 3B is between 110° and 170°, more preferably, between 135° and 160°, and most preferably, about 150°. This obtuse angle provides, especially in those embodiments of the present invention wherein the decorative building panels are utilized as a roofing panel, a simple and effective water barrier.

Also in both FIGS. 3 and 3B, the respective portions 18A and 18 of the second complementary means have interfacing sides which are likewise disposed at an angle greater than 90° C., measured in the counterclockwise direction, as depicted by arrows 22A and 22 in FIGS. 3A and 3B, from the long side, 1 and 1A, respectively. Preferably the angle depicted by the arrows 22A and 22 in FIGS. 3A and 3B is between 110 and 170°, more preferably between 135° and 160°, and most preferably about 150°. Also preferably, angles 22A and 22 are substantially identical, thereby providing a flush interface between portion 18A and portion 18.

Referring again to FIG. 1, it can be seen that the continuous interlocking assembly element 7 will not be intersected at all points with the non-continuous interlocking assembly elements 6 and, when the above angles are maintained, the continuous interlocking assembly element 7, even when not engaged with one of the non-continuous interlocking assembly elements 6, serves to provide an effective barrier for wind-blown rain. Even in those instances where wind-blown rain may make its way over the angled lip 12 of the continuous interlocking assembly element 7, the effective downward slope provided in the illustrated embodiment where the angle depicted is greater than 90°, provides an easy escape route for such wind-blown rain. This thus prevents the accumulation of stagnant water in dead air spaces within the completed building panel assembly.

As can also be seen in FIGS. 3A and 3B, the protrusions 18A and 18 are depicted generally as triangular in nature and, preferably, have angles 22A and 22 which are substantially identical to the angles 20A and 20 depicted for the lips 12A and 12. In this configuration, when protrusion 18A of the non-continuous interlocking assembly element 6 comes into interfacial contact with protrusion 18 of the continuous interlocking assembly element 7, the force supplied by the sliding of the side of protrusion 18A of FIG. 3A along the side of protrusion 18 of FIG. 3B causes the lip 12A of FIG. 3A to be forcibly inserted and maintained in groove 14 of FIG. 3B. Thus, the interfacial sliding of protrusion 18A in FIG. 3A over protrusion 18 in FIG. 3B provides the necessary force for forcibly engaging and maintaining the first complementary means in the engaged position. In addition, the force supplied by 18A in FIG. 3A sliding over protrusion 18 in FIG. 3B is sufficient to maintain vertically adjacent decorative panels in the engaged position so as to free the hands of the installer for the installation of nails through the nail holes 16 and into the sheathing, rafters and/or studs.

Figure 4:
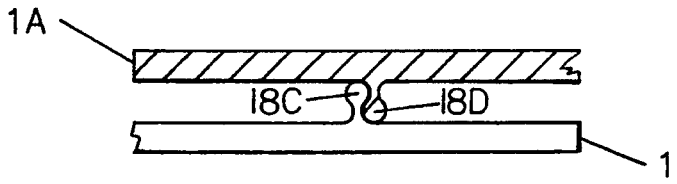
FIGS. 4 and 5 depict enlarged cross-sectional views of alternative second complementary means according to the present invention.
Figure 5:
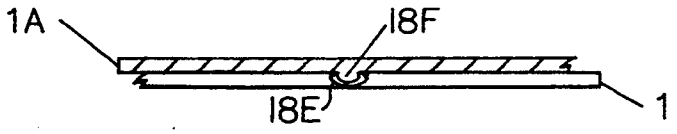

FIGS. 4 and 5 depict alternative embodiments of the second complementary means for forcing and maintaining the first complementary means in the engaged position. Specifically, FIG. 4 depicts a "raised bead" assembly comprised of elements 18C and 18D and FIG. 5 depicts a "snap and seal" assembly comprised of elements 18E and 18F which perform substantially the same function and provide substantially the same result as the second complementary means, elements 18A and 18 in FIGS. 3A and 3B, respectively.

In accordance with the above, it is seen that a building panel of the present invention is provided which, when installed on a wall, roof or other suitable surface, provides a very effective moisture shield and water shedding function for the substrate, thereby preventing the accumulation of water in stagnant air spaces behind and/or within each panel. Furthermore, the panels provided according to the present invention are substantially free of and otherwise immune from adverse weather conditions such as extremes in temperature as well as being secure from wind uplift. Also, the panels provided in accordance with the present invention provide ease of installation by assuring proper alignment to adjacent panels, both vertically and horizontally, as well as a secure and safe fit when locking vertically so that the panels will not slide down the roof and so that the hands of the installer are freed for the nailing operation. Finally, but without limitation, the panels according to the present invention provide a positive indication, such as a "click" sound, when the panels are properly engaged and the second complementary means have effectively performed their function, so as to alert the installer that the panel is appropriately in place.

As can also be understood from the above description, the interlock assembly as described above and depicted in FIGS. 3, 3A and 3B, need not be an integral part of a manufactured panel but, can be manufactured separately and adhered to a suitable building panel.

Moreover, the panels as depicted in FIG. 1 above can be manufactured by any suitable method, such as injection molding, compression molding, injection-compression molding and/or from an engineering structural foam. Preferred as a material for the building panels of the present invention are the family of NORYL resins available from General Electric Company.

All of the above-mentioned patents are incorporated herein by reference.

We claim:

1. A decorative building panel comprising;

(a) at least one course comprised of a plurality of decorative building elements;

(b) a continuous interlock assembly element disposed along one edge of said course;

(c) at least one non-continuous interlock assembly element disposed along an opposite edge of said course; and (d) a support rib disposed within each decorative building element, wherein said continuous interlock assembly element comprises (i) a first interlock assembly element having a first groove, a first lip and a first protrusion, and said first groove having an apex, and (ii) a second interlock assembly element having a second groove., a second lip and a second protrusion, said first lip being received in said second groove, said second lip being received in said first groove, said first protrusion being forcibly engaged and snapped into place with said second protrusion, said interlock assembly forcing said second lip in the direction of the apex of said first groove for engagement with said apex.

2. An interlock assembly for joining adjacent building panels, said assembly comprising:

(a) a first interlock assembly element having a first groove, a first lip and a first protrusion, and said first groove having an apex, and (b) a second interlock assembly element having a second groove, a second lip and a second protrusion, said first lip being received in said second groove, said second lip being received in said first groove, said first protrusion being forcibly engaged and snapped into place with said second protrusion, said interlock assembly forcing said second lip in the direction of the apex of said first groove for engagement with said apex.

3. The assembly of claim 2 wherein said protrusions are triangular in shape wherein adjacent sides of said protrusions are engaged to provide a flush interface.

* * * * *